US011783802B2

(12) United States Patent
Kennedy

(10) Patent No.: US 11,783,802 B2
(45) Date of Patent: Oct. 10, 2023

(54) TREMOLO BAR ATTACHMENT ACCESSORY DEVICE

(71) Applicant: Clinton A. Kennedy, Loveland, CO (US)

(72) Inventor: Clinton A. Kennedy, Loveland, CO (US)

( * ) Notice: Subject to any disclaimer, the term of this patent is extended or adjusted under 35 U.S.C. 154(b) by 0 days.

(21) Appl. No.: 17/075,570

(22) Filed: Oct. 20, 2020

(65) Prior Publication Data

US 2021/0125589 A1 Apr. 29, 2021

Related U.S. Application Data

(60) Provisional application No. 62/924,788, filed on Oct. 23, 2019.

(51) Int. Cl.
*G10D 3/153* (2020.01)

(52) U.S. Cl.
CPC ..... *G10D 3/153* (2020.02)

(58) Field of Classification Search
CPC ..... G10D 3/153; G10D 1/085; G10D 3/00
See application file for complete search history.

(56) References Cited

U.S. PATENT DOCUMENTS 7,435,178 B1 * 10/2008 Tam ..... G06F 3/011 84/743
2014/0251112 A1 * 9/2014 Kang ..... G10D 3/153 84/313
2016/0012804 A1 * 1/2016 VanHaight ..... G10D 3/153 84/313

* cited by examiner

*Primary Examiner* — Kimberly R Lockett
(74) *Attorney, Agent, or Firm* — Patent Authority LLC; Elliot Furman

(57) ABSTRACT

A tremolo bar attachment accessory device for removably attaching an accessory to the end of a tremolo bar. The accessory may be decorative, functional, or a combination of both. The device can be used with a variety of popular and well-known tremolo systems.

4 Claims, 11 Drawing Sheets

TREMOLO BAR ATTACHMENT ACCESSORY DEVICE

This application claims the benefit of U.S. Provisional Application No. 62/924,788 filed Oct. 23, 2019, which is hereby incorporated by reference.

BACKGROUND

A tremolo bar or tremolo arm, which is colloquially referred to as a whammy bar, is an angled metal bar that is inserted into a tremolo bridge of a guitar to form a mechanical vibrato system. In its most popular form, the bridge is spring loaded to balance the tension of the strings with the tension of the springs, with the bridge pivotedly attached to screws or a plate connected to the body of the guitar, thereby forming a fulcrum, or point on which the bridge can pivot.

Depending on the design of the bridge system, a guitar player can add certain expressive elements and sound effects while playing by pushing down and/or pulling up on the bar. For example, vibrato can be added by gently but quickly pushing down and pulling up on the bar in a rapid and repetitive fashion. A sound effect commonly referred to as a "dive bomb" can be made by pushing the bar down approximately as far as possible thereby grossly but intermittently detuning and lowering the pitch of the strings. In a "reverse dive bomb" the player pulls up on the bar thereby detuning and raising the pitch of the strings by an extreme amount. When the bar is not being touched by the player or when it is otherwise returned to its neutral steady state position, the bridge is essentially or approximately in a static position, and the strings of the guitar remain tuned as if the bridge of the guitar was fixed in position. Some well-known examples of tremolo bridges include a Floyd Rose tremolo and a Fender tremolo. No matter the type and specific design of a tremolo bridge, they all include a tremolo bar that can be manipulated by a player for more expressive playing.

A need presently exists for an accessory for attaching a variety of decorative and/or functional items to the free end of a tremolo bar. A need presently exists for an attachment accessory that is universal in that it can be used with any tremolo bar commonly used with various tremolo systems in use nowadays.

SUMMARY

A tremolo bar attachment accessory device for removably attaching an accessory to the end of tremolo bar comprises an accessory and insert. The accessory comprises a hollow cavity. The hollow cavity extends from the interior to the exterior of the accessory. The insert comprises a first end, a second end, an exterior surface, and an interior cavity. The first end is open. The interior cavity is in the shape of the end of tremolo bar. The insert is affixed within the hollow cavity of the accessory with the first open end of the insert facing out towards the exterior of the accessory.

DETAILED DESCRIPTION

Figure 1:
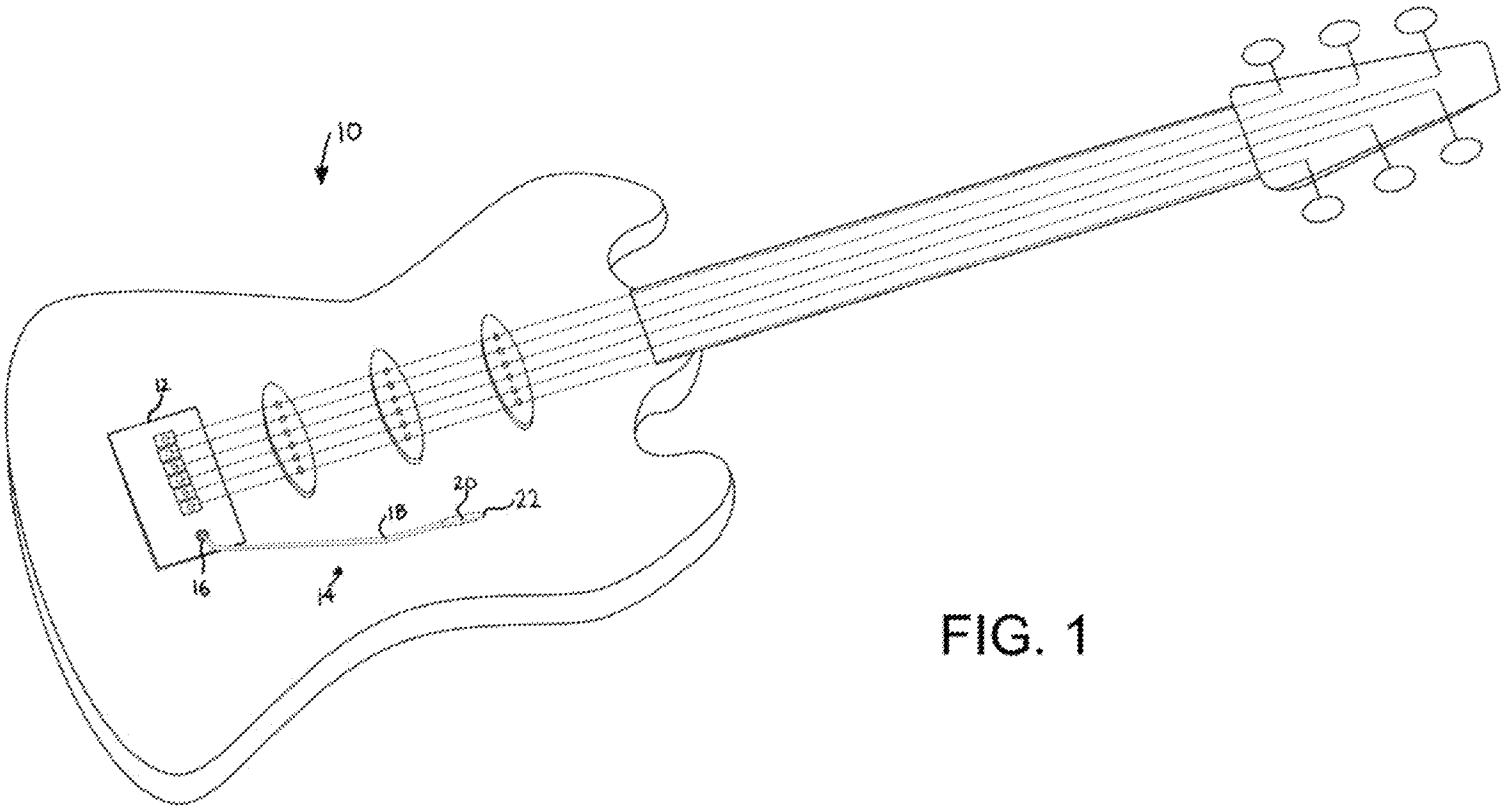
FIG. 1 shows a guitar with a tremolo bridge.
Figure 2:
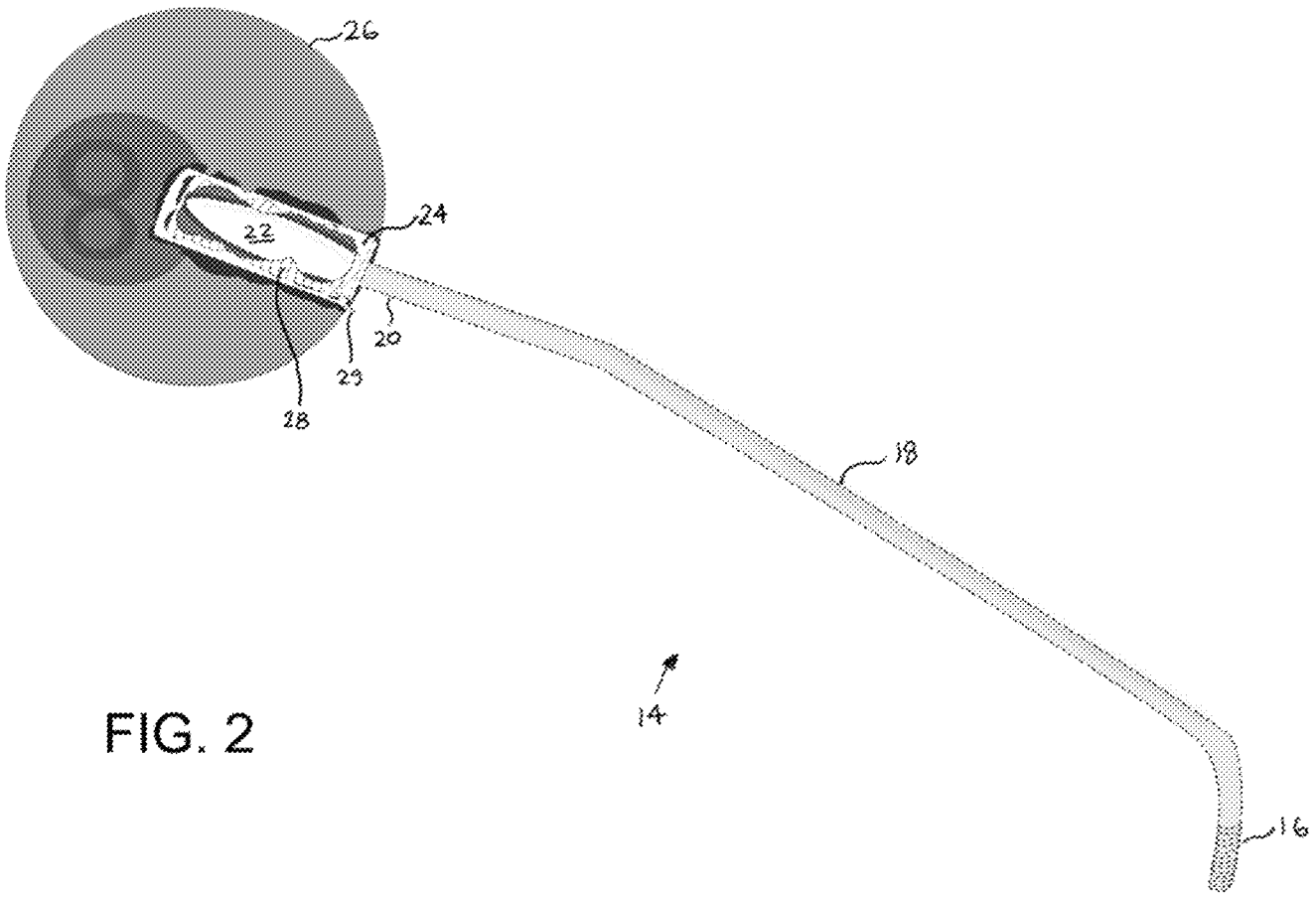
FIG. 2 shows a tremolo arm with an accessory attached.

FIG. 1 shows a guitar 10 with a tremolo bridge 12. The tremolo bar 14 is connected to the bridge 12. The tremolo bar 14 is several inches long and made of a cylindrical or generally cylindrical piece of metal. A first end of the tremolo bar 16 is generally angled at approximately ninety (90) degrees as shown in FIG. 2 and inserted, for example pushed or threaded, depending on the specific type of bridge, into a hole in the bridge. A central portion 18 of the bar extends to a second end, or free end 20 of the bar and extends several inches out of the bridge for manipulation by the player. Depending on the manufacturer of the bar, the central portion 20 may be curved, straight, angled, or some combination thereof as shown by way of example in FIG. 2. The angles and curves of the bar may vary from manufacturer from manufacturer, but these angles and curves, if any, are immaterial to the present invention as the second, or free end 20 of the bar 14 is generally straight in all widely used and available bars of the past and present. The second end may optionally include a removeable plastic or rubber arm tip 22, colloquially referred to as a "whammy bar grip", inserted over the second free end 20.

FIG. 2 shows an exemplary tremolo arm 14 with an exemplary accessory 26 attached to the second end 20 of the bar 14. The interior of the accessory 26 is shown in dotted lines. A bar grip 22 is connected to the second end 20 of the bar 14. A universal sleeve 24, also referred to equivalently as an "insert", is attached over the bar grip 22. The universal sleeve 24 has male external threads (25 of FIGS. 3 and 4) on the exterior surface of the sleeve 24. The interior of the attachment includes interior female threads 28 (also see FIG. 5). The accessory 26 is removably attached to the universal sleeve 24 by mating the threads 28 of the accessory 26 and sleeve 24, and rotating the attachment down onto the sleeve 24, thereby attaching the accessory 26 to the second end 20 of the tremolo bar 14. The terms "universal sleeve" and "insert" are used interchangeably herein.

Figure 3:
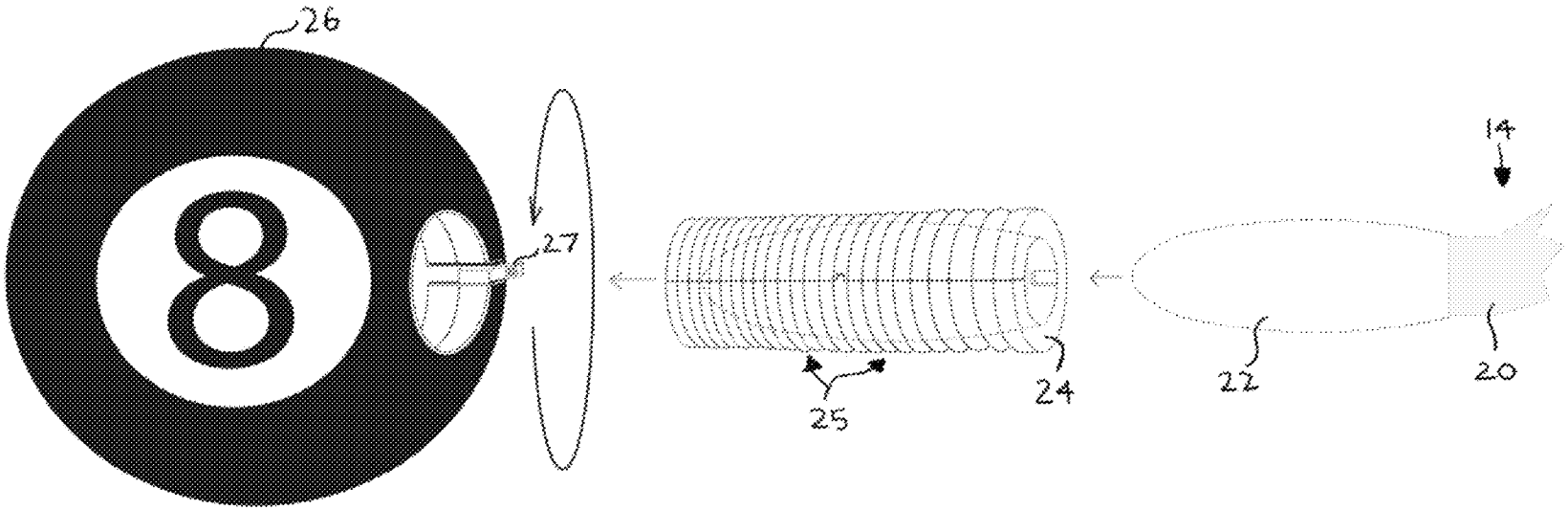
FIG. 3 shows the disassembled components of a tremolo bar attachment accessory device.

FIG. 3 shows the disassembled components of a tremolo bar accessory attachment device. As disclosed, a whammy bar grip 22 is connected to the second end 20 of the bar 14. Typically, this is a plastic or rubber grip into which the bar 14 is inserted. Many bars 14 come with the grip attached and replacement grips are available from many sources. The universal sleeve 24 with external threads 25 is inserted over the bar grip 22. The accessory 26 is threaded onto the universal sleeve 24

Figure 4:
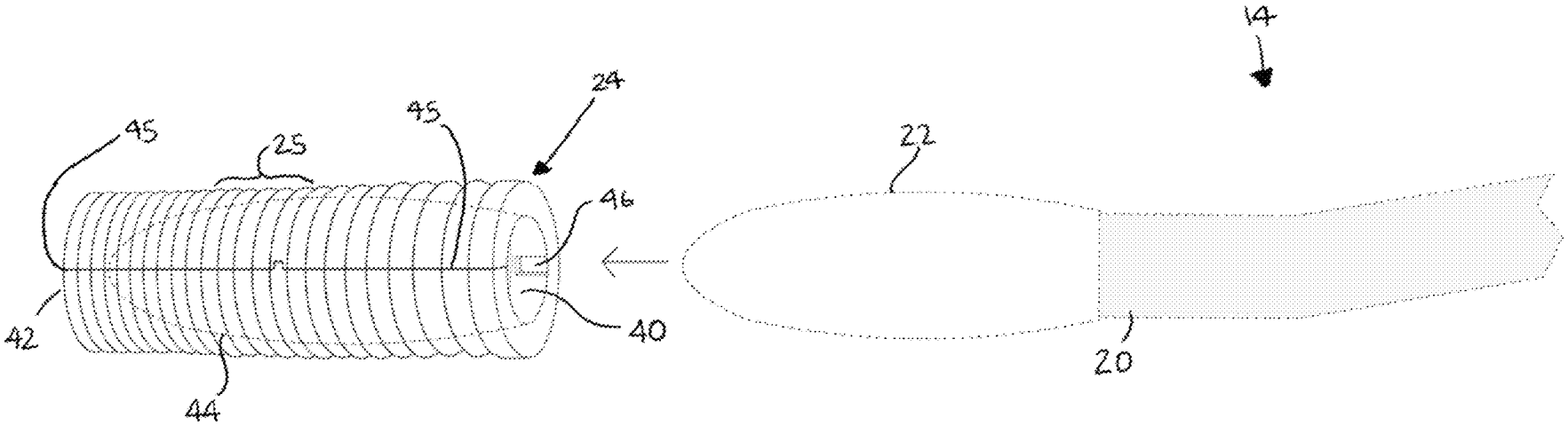
FIG. 4 shows a universal sleeve.

Turning to FIG. 4, the universal sleeve 24 is generally cylindrical. It has a first end 40, a second end 42, and exterior surface, and an interior cavity 44 which is shown in dotted lines. The interior cavity 44 is generally oblong, such as like a spheroid or ellipsoid, to approximate the shape of whammy bar grips such as bar grip 22. The interior carrier may include a non-slip finish, surface, or include a non-slip material. Examples of non-slip finishes or materials include by way of example, rubber, plastic, glues, adhesives, tapes, protrusions, and a textured surface such as would be obtained by way of rubbing or finishing the surface with an abrasive. This helps secure the sleeve 24 to the bar grip 22 and eliminate movement, slippage, or rotation of the sleeve 24 relative to the bar 14.

The universal sleeve 24 may be made of materials such, but not limited to, plastic and metal. The universal sleeve 24 has external male threads 25 that are identical to and mateable with the internal female threads 28 of the attachment accessory 26 (see FIG. 5). The universal sleeve 24 includes a lengthwise opening 45 extending from the first end 40 to the second end 42 and passing through the wall of the sleeve 24 which is defined by the interior cavity 22 and the external threads 25. The opening 45 allows the universal sleeve to open up slightly under pressure to adjust for the size and shape of the bar grip 22 which varies from manufacturer to manufacturer. It also helps secure the sleeve 24 to the bar grip 22 by created additional frictional pressure that is created by forcefully opening the sleeve 24 over the grip 22 and by the outward force provided by a partially compressed grip. In this way, the sleeve is attached to the bar 14, allowing for removably affixing the sleeve 24 to the attachment by rotatedly threading the attachment 26 onto and off of the sleeve 24.

Figure 5:
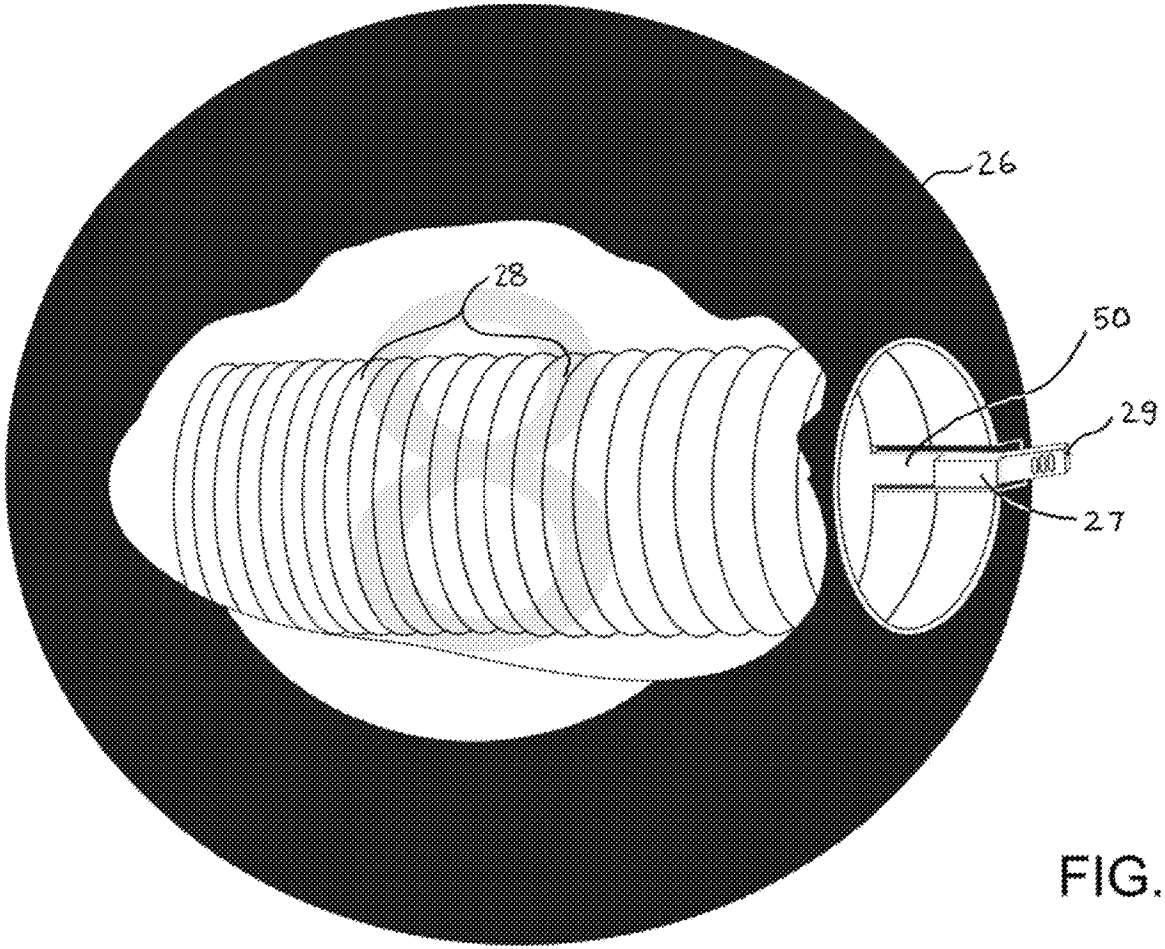
FIG. 5 shows a cutaway view of an attachment accessory.

The attachment 26 can be completely and tightly threaded onto the adapter 24, akin to tightening a nut on a bolt. The universal sleeve 24 may also include a notch 46 as shown in FIG. 4. The attachment accessory 26 may include a protrusion 27 as shown in FIGS. 3 and 5.

When the accessory 26 is fully threaded onto the sleeve 24, the protrusion 27 mates with the notch 46 thereby locking the attachment in position relative to the bar 14. In one example, the protrusion 27 is a rigid but deformable material such as plastic such that in order to the remove, or unthread the accessory 26 from the sleeve 24, sufficient rotational force must be supplied to deform the protrusion 46 such that it slides out of or releases from the notch 46. In another example, the lock includes a tab 29 connected to the protrusion 27 to form a thumb lock. The tab 29 is pulled or pushed to aid in releasing the protrusion 27 from the notch 46. In another example a button spring clip is affixed to a slot 50 in the attachment accessory 26. Button spring clips are well known by those having ordinary skill in the art. A button spring clip is generally a v-shaped flat piece of spring metal. One end is flat and straight. The other end has a small "button" protrusion. In this example the straight end is affixed to the slot 50, for example with an adhesive such as glue. The button mates with the notch 46 of the sleeve 24 shown in FIG. 4. By pressing down on the button end of the spring, the button is released from the notch and the accessory 26 can be rotatedly removed from the sleeve 24, and thereby the tremolo arm 14.

Figure 6:
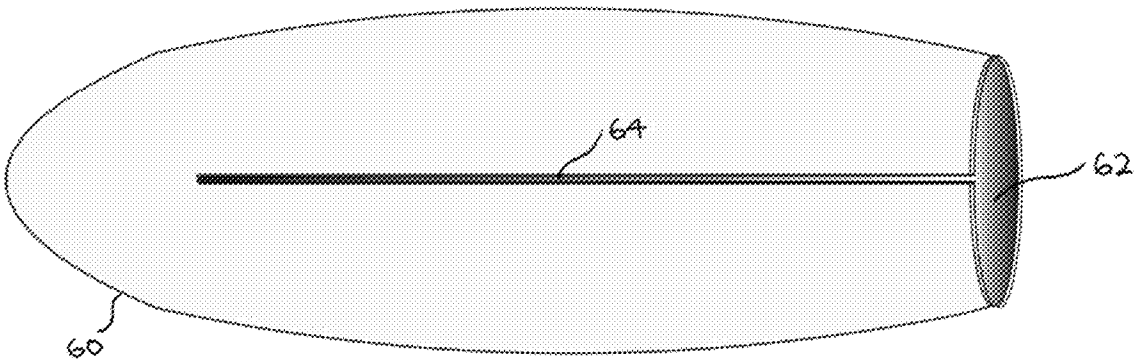
FIG. 6 shows a bar grip adapter.

Turning back to FIG. 1, the tremolo bar 14 includes a grip 22. However, some tremolo bars are "gripless" in that the end of the bar is not capped with anything; it is bare metal. In this case, the present accessory attachment device includes a bar grip adapter 60 as shown in FIG. 6. The bar grip adapter 60 is made of a material such as plastic or rubber, or another material that is semi-rigid or deformable, and has some non-slip or reduced-slip properties, like rubber or plastic. As disclosed above in relation to bar grips in general, the interior cavity 44 of the universal sleeve 24 is generally oblong and the shape of the bar grip adapter 60. In one example, the factory supplied bar grip of the tremolo arm may be removed and replaced by the bar grip adapter 60 which may be more customized in shape to the interior cavity of 44 of the universal sleeve 24.

Figure 7:
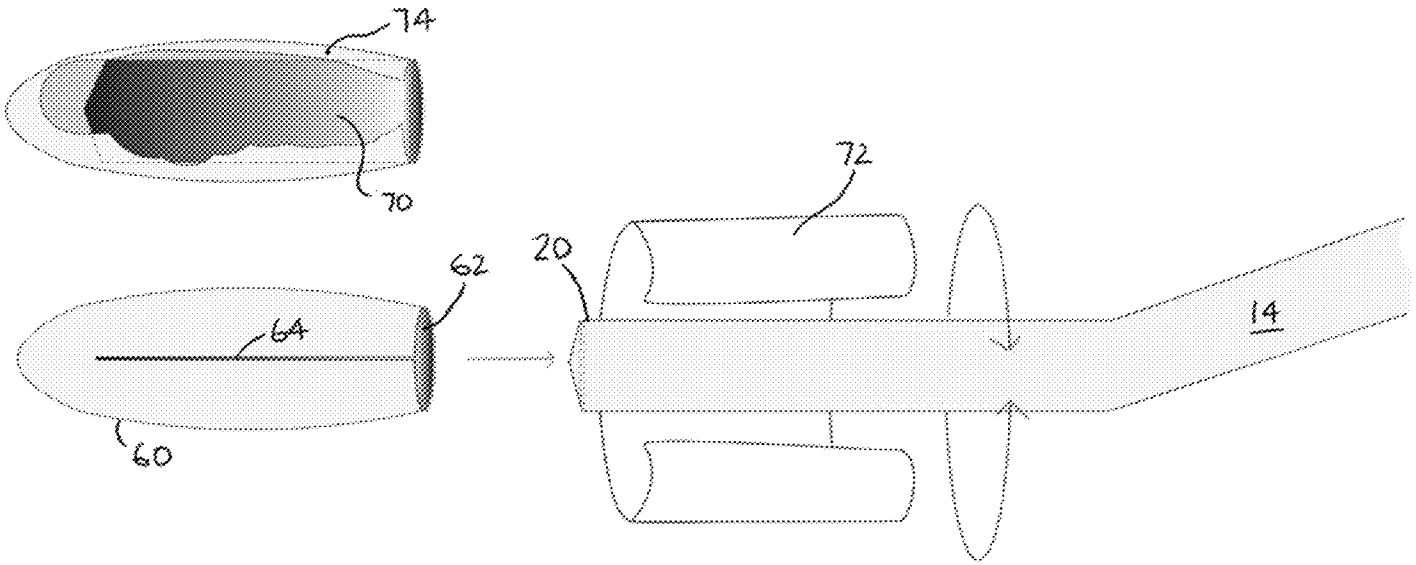
FIG. 7 shows a cutaway view of a bar grip adapter.

The bar grip adapter 60 is connected to the bar 14 by sliding it over the second end 20 of the bar 14. The diameter of a tremolo bar can vary depending on the manufacturer from around 0.2" to 0.25". The bar grip adapter 60 includes a partial lengthwise opening 64 extending from the open end 62. This allows the bar grip adapter 60 to accommodate varying diameters of bars. Furthermore, as shown in FIG. 7, this permits easier installation over the bar. In one method of securing the bar grip adapter 60 on the bar 14, a piece of two-sided tape 72 is wrapped around the second end 20 of the bar 14. Then the end 62 of the adapter 64 is pulled open slightly, facilitated by the opening 64, and the adapter 60 is secured onto the bar 14 by the two-sided tape 72. Next, the universal sleeve 24 may be slipped onto and over the bar grip adapter 60, and an attachment 26 can be added as disclosed above. The interior of the bar grip adapter 60 may include a textured non-slip interior 70 and exterior 74.

Figure 8:
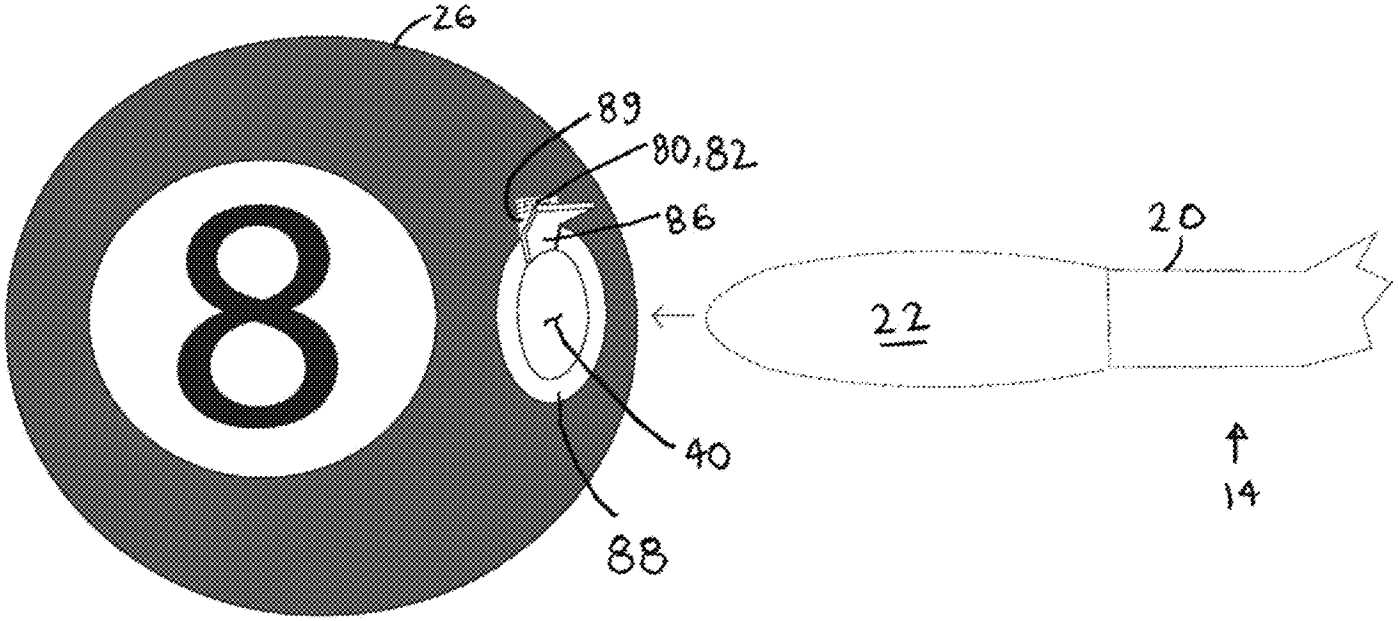
FIG. 8 shows a perspective view of an exemplary accessory with alternative insert with thumb release, and a tremolo arm not attached to the accessory.

In an alternate embodiment, FIG. 8 shows a perspective view of an exemplary accessory 26 having alternative insert 88 with thumb release 86, and a tremolo arm 14 not attached to the accessory 26. The alternate insert 88 is affixed within a hollow cavity in the exemplary accessory 26. The insert 88 is affixed with, for example, an adhesive such as glue, thereby forming a permanent bond between the insert 88 and the accessory 26. The whammy bar grip 22 is inserted into the open end 40 of the insert 88. When inserted into the cavity (44 of FIG. 9) of the insert, the whammy bar is held in place by friction between the whammy bar grip 22 and the interior cavity 44. Additional friction to lock the accessory in place is provided by a spring-loaded tab comprising a spring 80 and a tab 86 (also referred to herein as a "thumb release"). The spring 80 provides a downward pressure on the thumb release or tab 86. The whammy bar is released by pulling up on the thumb release 86, which compresses spring 80 within spring cavity 89.

Figure 9:
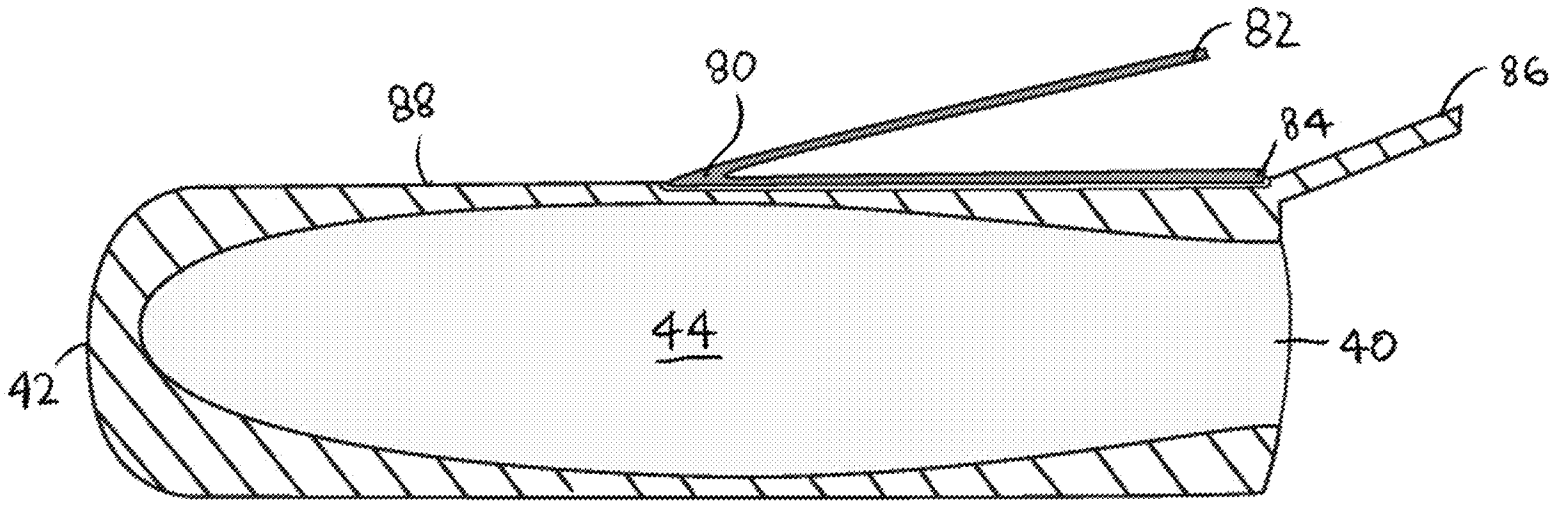
FIG. 9 shows a cross-section view of the alternative insert.
Figure 10:
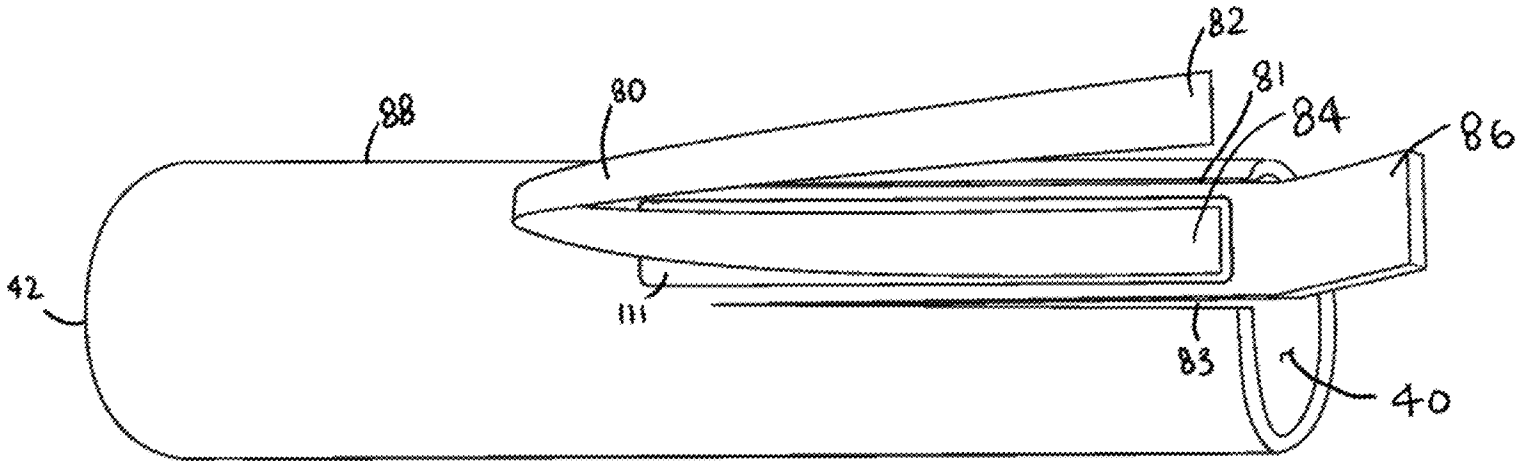
FIG. 10 shows a top perspective view of the alternative insert.

FIG. 9 shows a cross-section view of the alternative insert 88. FIG. 10 shows a top perspective view of the alternative insert 88. The insert 88 is generally cylindrical. It has a first end 40 and a second end 42 defining an interior cavity 44, shown in dotted lines. The interior cavity 44 was disclosed above with reference to FIG. 4.

The insert 88 has an exterior that is generally cylindrical and shown in FIGS. 8-11, but it may be any shape. The accessory 26 comprises an accessory cavity which is formed in the accessory 26, for example in the case of an "8 ball", by drilling into the center of the ball. The accessory cavity is formed so that the insert 88 can be inserted and glued within it. As will be disclosed below, accessories may comprise an almost infinite number of functional and/or decorative items. So, the "8-ball" accessory 26 and connecting the insert 88 within the accessory is shown and described by way of example, and not by limitation. Other accessories and means of joining accessories with the insert will be disclosed below.

The interior cavity 44 of the insert 80 is generally oblong to approximate the shape of whammy bar grips such as bar grip 22. The interior cavity 44 may include a non-slip finish or include a non-slip material. Examples of non-slip finishes or materials include by way of example, rubber, plastic, glues, adhesives, tapes, protrusions, and a textured surface such as would be obtained by way of rubbing or finishing the surface with an abrasive. This helps secure the sleeve 88 to the bar grip 22 and eliminate movement, slippage, or rotation of the sleeve 88 relative to the bar 14.

A spring 80 is connected to a tab 86. One example of a spring 80 is a generally v-shaped flat piece of spring metal as shown having a bottom section 84 and a top section 88.

Other springs may be used. The bottom section 84 is affixed to the tab 86. It may be affixed with an adhesive such as a glue, or by any other conventional means. The tab is formed by two slits 81, 83 extending longitudinally from the open end 40 of the insert 40 towards the center of the insert, as shown in FIG. 10.

Figure 11:
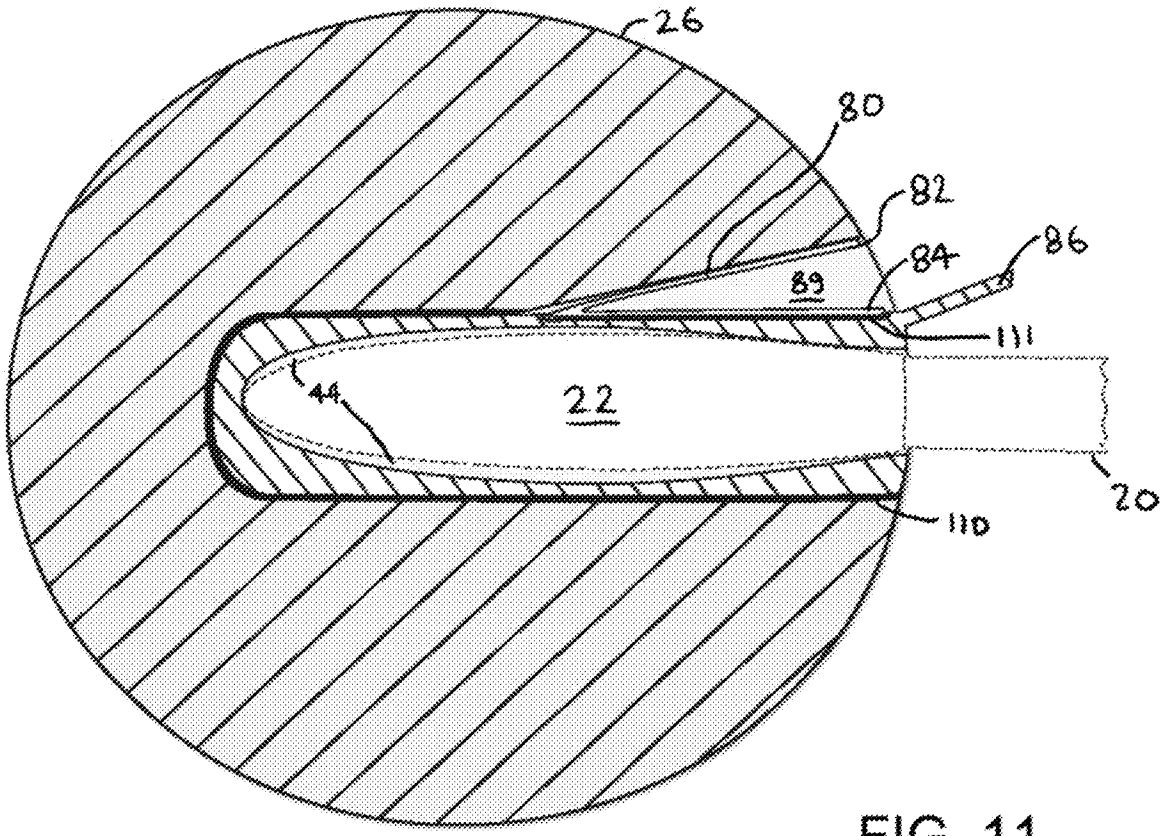
FIG. 11 shows cross-section view of an exemplary accessory with the alternative insert, attached to a tremolo arm end.

FIG. 11 shows cross-section view of an accessory 26 with the alternative insert, attached to a tremolo arm end. The insert is affixed to the interior of the accessory 26, for example with a glue or another type of adhesive or type of bonding, as indicated by thick line 110. The spring 80 is connected to release 86 as indicated by thick line 111. A generally v-shaped spring cavity 89 is formed in the accessory 26 to accommodate the spring 80. As disclosed above, the tremolo arm end 20 comprising a bar grip 22 is held within cavity 44 by friction between the bar grip 22 and walls of the cavity 44, and additional friction provided by the downward pressure of spring 80 on the tab 86. The accessory attachment 26 may be released from the tremolo arm 14 by pulling up on tab 86. This compresses the spring 80 within spring cavity 89, allowing the accessory 26 to be released, for example by pulling off the accessory attachment 26 from the tremolo bar end 20.

In view of the present disclosure, attachment accessories 26 may take nearly any form. Any accessory can be removeably attached to almost all, and by far the most popular whammy bars in use today and since the advent of mechanical tremolo systems.

Other accessories may be mounted directly on or to the insert 88 and, as disclosed above, the exterior of the insert 88 may comprise any shape, such as rectangular, or any regular or irregular shape, having any sort of contour, in nearly any shape or configuration. For example, the insert 88 may have a flat exterior surface onto which an accessory can be connected by any conventional or well-known means of attachment, such as, but not limited to, glues, adhesives, tapes, and mechanical fasteners such as screws, bolts, and rivets. Furthermore, the exterior of the insert 88 may be in the form of or comprise a fastener that mates with a fastener connected to the accessory. For example, the insert 88 may comprise half of slide-release buckle, with the other half of the slide-release buckle connected to or integrated on or within the accessory. This is just one example. Any type of clip, buckle, locking slide-release mechanism, and the like may be used.

Attachment accessories can be ornamental, they can be functional, or both ornamental and functional. An "f" or "o" or both are included in parenthesis next to the following examples to illustrate whether an attachment is functional or ornamental, or both. It should be evident by those having ordinary skill in the art whether an accessory, including those not listed here, is ornamental, functional, or both.

By way of example, and in some cases scaled down in size and/or reduced in weight, some examples of attachment accessories include but are in no way limited to: an 8-ball (o), a shifter knob (o), a pin-up girl (o), a clown head (o), a skull (o), an axe head (o), a medieval mace (o), a ball battle mace (o), a bowling ball (o), a basketball (o), a golf ball (o), other sports balls (o), a flexible flashlight (f), a multitude of colored lights (f,o), a laser (f,o), an action camera such as a product commonly sold under the trademark GOPRO (f), a camera mount (f), a pink flamingo (o), a hello kitty character (o), a plastic fish (o), a lightning bolt design (o), a unicorn (o), a one-way sign (o), a cross (o), a devil's head (o), a happy face (o), a glass or plastic eye ball (o), a shell or bullet such as a 50-calibre shell (o), and an alien head (o). These decorative and/or functional items are provided only to illustrate that in view of the present disclosure, an attachment accessory 26 may take almost any form. In this way, a guitar can be customized to the tastes, personality, and needs of a guitar player.

The foregoing detailed description has discussed only a few of the many forms that this invention can take. It is intended that the foregoing detailed description be understood as an illustration of selected forms that the invention can take and not as a definition of the invention. It is only the claims, including all equivalents, that are intended to define the scope of this invention.

What is claimed is:

1. A tremolo bar attachment accessory device for removably attaching an accessory to the free end of a tremolo bar comprising:

an accessory comprising a hollow cavity extending from the interior to the exterior of the accessory;

an insert comprising a first end, a second end, an exterior surface, and an interior cavity, wherein the first end is open, wherein the interior cavity is in the shape of the free end of a tremolo bar, wherein the insert is affixed within the hollow cavity of the accessory with the first end facing out towards the exterior of the accessory; and means for locking and releasing the attachment accessory device to and from the free end of the tremolo bar;

wherein the means for locking and releasing comprises a spring-loaded tab.

2. A tremolo bar attachment accessory device for removably attaching an accessory to the free end of a tremolo bar comprising:

an accessory comprising a hollow cavity extending from the interior to the exterior of the accessory;

an insert comprising a first end, a second end, an exterior surface, and an interior cavity, wherein the first end is open, wherein the interior cavity is in the shape of the free end of a tremolo bar, wherein the insert is affixed within the hollow cavity of the accessory with the first end facing out towards the exterior of the accessory; and means for locking and releasing the attachment accessory device to and from the free end of the tremolo bar;

wherein the means for locking and releasing comprises a protrusion and notch arranged in the hollow cavity of the accessory and on the exterior surface of the insert that engage with each other when the insert is affixed within the hollow cavity of the accessory.

3. A tremolo bar attachment accessory device comprising:

an insert comprising a first end, a second end, an exterior surface, and an interior cavity, wherein the first end is open, wherein the insert connects to a free end of a tremolo bar through the first end and into the interior cavity;

an ornamental accessory; and attachment means for attaching the insert to the ornamental accessory;

wherein the insert comprises a spring-loaded tab connected near the first end of the insert and extending beyond the first end of the insert.

4. A tremolo bar attachment accessory device comprising:

an insert comprising a first end, a second end, an exterior surface, and an interior cavity, wherein the first end is open, wherein the insert connects to a free end of a tremolo bar through the first end and into the interior cavity;

an ornamental accessory;

attachment means for attaching the insert to the ornamental accessory; and a bar grip adapter designed to be fitted over the end of a tremolo bar and having an exterior surface having the same shape as the interior cavity of the insert.

* * * * *